US008274471B2

(12) United States Patent
Kim et al.

(10) Patent No.: US 8,274,471 B2
(45) Date of Patent: Sep. 25, 2012

(54) LIQUID CRYSTAL DISPLAY DEVICE AND METHOD FOR DRIVING THE SAME

(75) Inventors: Min Hwa Kim, Gyeongsangbuk-do (KR); Ju Han Kim, Daegu-si (KR); Wook Jeon, Deajeon-si (KR); Jae Won Shin, Busan-si (KR); Rok Hee Lee, Seoul (KR); Tae Yoon Kang, Busan-si (KR)

(73) Assignee: LG Display Co., Ltd., Seoul (KR)

( * ) Notice: Subject to any disclaimer, the term of this patent is extended or adjusted under 35 U.S.C. 154(b) by 823 days.

(21) Appl. No.: 12/292,998

(22) Filed: Dec. 2, 2008

(65) Prior Publication Data

US 2009/0140973 A1 Jun. 4, 2009

(30) Foreign Application Priority Data

Dec. 3, 2007 (KR) ..... 10-2007-124416

(51) Int. Cl.
*G09G 3/32* (2006.01)
*G09G 3/36* (2006.01)

(52) U.S. Cl. ..... 345/102; 345/82

(58) Field of Classification Search ..... 345/102, 345/82

See application file for complete search history.

(56) References Cited

U.S. PATENT DOCUMENTS 5,786,801 A * 7/1998 Ichise ..... 345/102
7,295,180 B2 * 11/2007 Ichikawa et al. ..... 345/102
7,969,430 B2 * 6/2011 Korcharz et al. ..... 345/211
2004/0108982 A1 * 6/2004 Krohn ..... 345/82
2008/0019147 A1 * 1/2008 Erchak et al. ..... 362/607
2008/0062118 A1 * 3/2008 Park ..... 345/102
2009/0278862 A1 * 11/2009 Shimodaira ..... 345/690

* cited by examiner

*Primary Examiner* — Bipin Shalwala
*Assistant Examiner* — Ryan A Lubit
(74) *Attorney, Agent, or Firm* — Morgan, Lewis & Bockius LLP

(57) ABSTRACT

A liquid crystal display (LCD) device and a method for driving the same, which are capable of achieving an enhancement in display quality, are disclosed. The LCD device includes a display panel for displaying an image, a backlight unit comprising a plurality red light sources, a plurality of green light sources, and a plurality of blue light sources, a backlight driver for controlling a duty rate of a first drive signal to drive the red light sources, a duty rate of a second drive signal to drive the green light sources, and a duty rate of a third drive signal to drive the blue light sources, in accordance with a control signal including color coordinate information and luminance information, a luminance corrector for varying the luminance information of the control signal when the duty rate of one of the first to third drive signal is 100%, and a light sensor for sensing light beams from the light sources, generating light sensing signals based on the sensed light beams, and supplying the light sensing signals to the backlight driver and to the luminance corrector.

5 Claims, 5 Drawing Sheets

First Drive Signal

Second Drive Signal

Third Drive Signal

First Drive Signal

Second Drive Signal

Third Drive Signal

LIQUID CRYSTAL DISPLAY DEVICE AND METHOD FOR DRIVING THE SAME

This application claims the benefit of the Korean Patent Application No. 10-2007-124416, filed on Dec. 3, 2007 which is hereby incorporated by reference as if fully set forth herein.

BACKGROUND OF THE INVENTION

1. Field of the Invention

The present invention relates to a liquid crystal display device, and more particularly, to a liquid crystal display device and a driving method thereof which are capable of preventing generation of a residual image upon power-off.

2. Discussion of the Related Art

Display devices are classified into an emissive display device such as a cathode ray tube, an organic electro-luminescence display device, or a plasma display device (PDP), which can emit light by itself, and a non-emissive display device such as a liquid crystal display (LCD) device, which cannot generate light by itself, so that it requires a separate light source.

A general LCD device includes two display panels provided with electric field generating electrodes, and a liquid crystal layer interposed between the display panels. The liquid crystal layer has dielectric anisotropy. In the LCD device, an electric field is generated at the liquid crystal layer as a voltage is applied to the electric field generating electrodes. The intensity of the electric field is adjusted as the voltage is varied. In accordance with the adjustment of the electric field intensity, the transmittance of light passing through the liquid crystal layer is controlled. Thus, a desired image is obtained. The light may be light generated from a separate artificial light source provided at the LCD device, or may be natural light.

For the light source of the LCD device, several lamps are typically used. In particular, for a light source capable of uniformly supplying light to the overall portion of the liquid crystal panel at the back surface of the liquid crystal panel, a fluorescent lamp such as an external electrode fluorescent lamp (EEFL) or a cold cathode fluorescent lamp (CCFL), or a light emitting diode (LED) is used.

Since the LCD device, which is a non-emissive display device, displays an image, using light emitted from a backlight, the display quality of the LCD device is determined in accordance with the luminance of the backlight. However, the backlight source has a problem in that a luminance deviation is exhibited due to ambient temperature, the heat internally generated from the display device, and non-uniform characteristics of the backlight source. Such a luminance deviation, which may occur in all light sources, causes a degradation in the display quality of the LCD device.

In particular, the most excellent advantage of an LED backlight for an LCD device, which is being actively researched and developed, is that light beams respectively emitted from red, green, and blue light sources are supplied in a mixed state to the LCD device. However, the LED used for a backlight source exhibits an abrupt light efficiency variation due to heat. In other words, the LED responds sensitively to the surrounding environment of the LCD device or the internal heat source of the LCD device, thereby causing the balance of colors to collapse.

In other words, each light source is gradually degraded as the driving time thereof increases, so that the drivability thereof is degraded. That is, although a drive signal having an initially-set duty rate is always supplied, the light source cannot provide an original luminance. In order to prevent this phenomenon, the backlight driver increases the duty rate of the drive signal so that the light sources can output a normal luminance. However, it is difficult to compensate for the luminance of the light sources, only through an increase in duty rate, when the luminance of the light sources decreases to about 50% of the original luminance. This is because the drive signal has a limited margin period. If any one of the three-color light sources cannot generate a normal luminance due to the above-mentioned reason, even though the remaining two light sources generate the normal luminance, the luminance of the color-mixed light is degraded. Furthermore, the color of the mixed light is different from a target color.

SUMMARY OF THE INVENTION

Accordingly, the present invention is directed to a liquid crystal display device and a method for driving the same that substantially obviate one or more problems due to limitations and disadvantages of the related art.

An object of the present invention is to provide a liquid crystal display device and a method for driving the same, which are capable of normally maintaining a desired color, even though the luminance of light sources are reduced from an original luminance, thereby achieving an enhancement in display quality.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a liquid crystal display device comprises: a display panel for displaying an image; a backlight unit comprising a plurality red light sources, a plurality of green light sources, and a plurality of blue light sources; a backlight driver for controlling a duty rate of a first drive signal to drive the red light sources, a duty rate of a second drive signal to drive the green light sources, and a duty rate of a third drive signal to drive the blue light sources, in accordance with a control signal including color coordinate information and luminance information; a luminance corrector for varying the luminance information of the control signal when the duty rate of one of the first to third drive signal is 100%; and a light sensor for sensing light beams from the light sources, generating light sensing signals based on the sensed light beams, and supplying the light sensing signals to the backlight driver and to the luminance corrector.

In another aspect of the present invention, a method for driving a liquid crystal display device including a display panel for displaying an image, a backlight unit comprising a plurality red light sources, a plurality of green light sources, and a plurality of blue light sources, a backlight driver for controlling a duty rate of a first drive signal to drive the red light sources, a duty rate of a second drive signal to drive the green light sources, and a duty rate of a third drive signal to drive the blue light sources, in accordance with a control signal including color coordinate information and luminance information, and a light sensor for sensing light beams from the light sources, generating light sensing signals based on the sensed light beams, and supplying the light sensing signals to the backlight driver and to a luminance corrector comprises:

checking the first to third drive signals from the backlight driver, and first to third sensing signals from the light sensor, thereby identifying a drive signal having a duty rate of 100%, and a luminance of light sources driven by the drive signal having the duty rate of 100%; selecting a luminance correction value from a plurality of previously-stored luminance correction values in accordance with the results of the identification and the control signal supplied from an outside of the liquid crystal display device, and outputting the selected luminance correction value; and varying the luminance information of the control signal, using the selected luminance correction value, and supplying the resultant control signal, which includes the varied luminance information, to the backlight driver.

The liquid crystal display device and the driving method thereof according to the present invention have the following effect.

That is, in accordance with the present invention, it is possible to achieve an enhancement in display quality by normally maintaining the color of the displayed image while reducing the total luminance of the three-color-mixed light.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
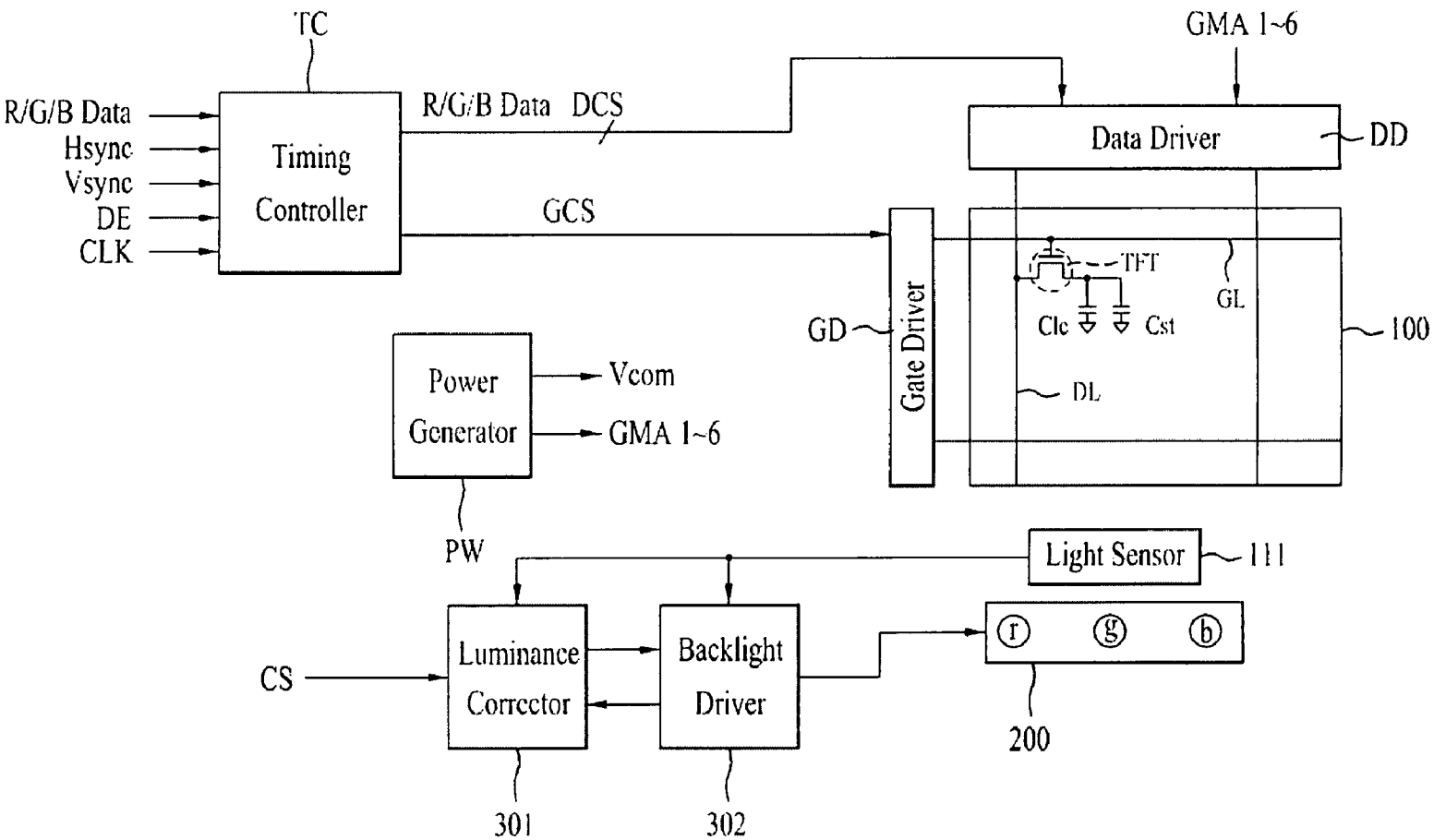
FIG. 1 is a block diagram illustrating a liquid crystal display (LCD) device according to an exemplary embodiment of the present invention.
Figure 2:
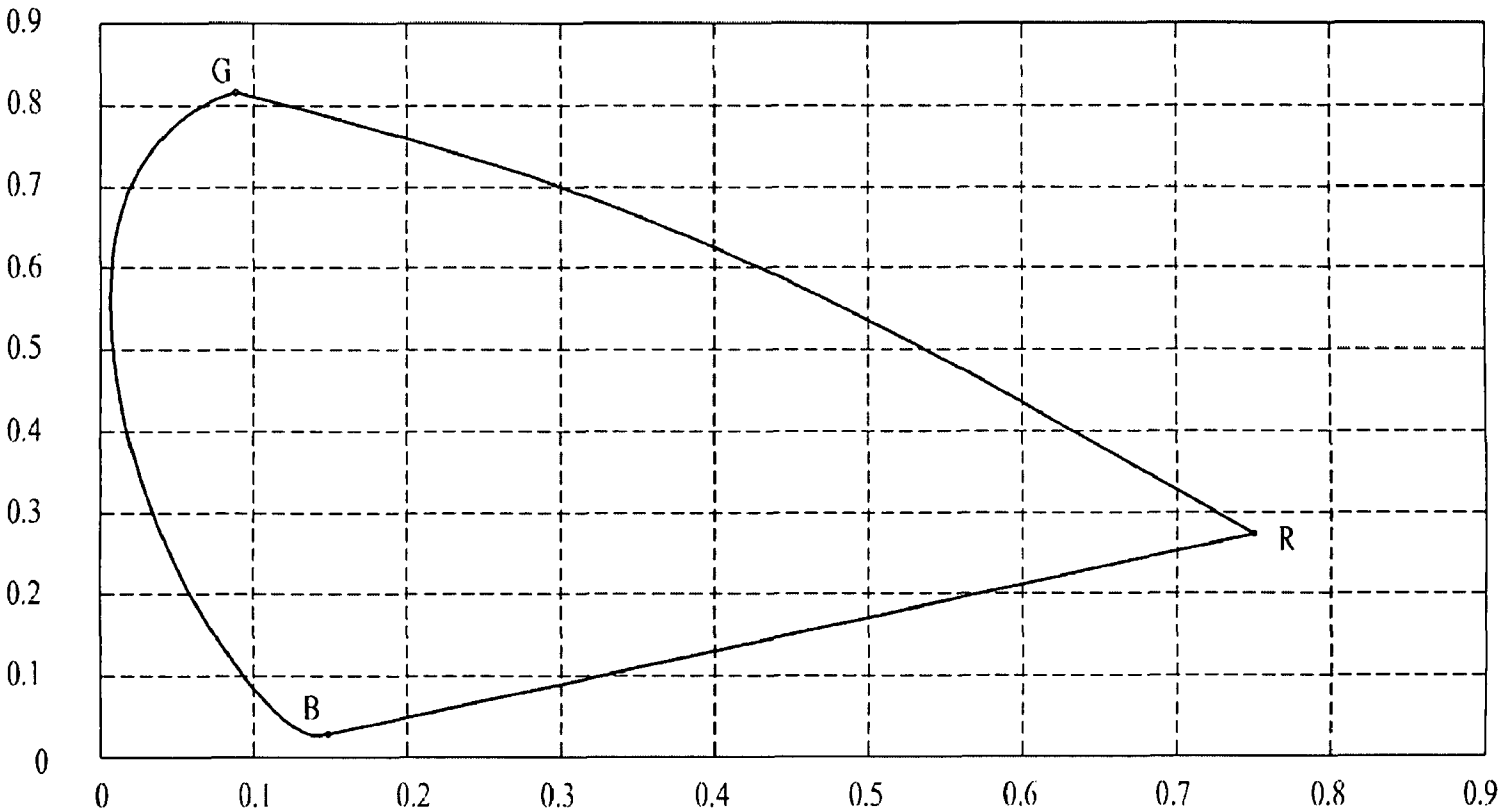
FIG. 2 is a CIE chromaticity diagram.

FIG. 1 is a block diagram illustrating a liquid crystal display (LCD) device according to an exemplary embodiment of the present invention. FIG. 2 is a CIE chromaticity diagram.

As shown in FIG. 1, the LCD device according to the illustrated embodiment of the present invention includes a display panel 100 including gate lines GL and data lines DL intersecting with each other, and thin film transistors (TFTs) formed at respective intersections of the gate lines GL and data lines DL. The LCD device also includes a data driver DD for inputting data to the data lines DL of the display panel 100, a gate driver GD for inputting a scan pulse to the gate lines GL of the display panel 100, a backlight unit 200 including a plurality of light sources r, g, and b for irradiating light to the display panel 100, and a backlight driver 302 for driving the light sources r, g, and b of the backlight unit 200. The LCD device further includes a luminance corrector 301 for varying information of a control signal CS input from the outside of the LCD device in accordance with duty rates of first to third drive signals from the backlight driver 302, a light sensor 111 for sensing light beams from the light sources r, g, and b, generating sensing signals based on the sensed light beams, and supplying the sensing signals to the luminance corrector 301 and backlight driver 302, and a timing controller TC for controlling the data driver DD, gate driver GD, luminance corrector 301, and backlight driver 302.

The plurality of light sources r, g, and b include a plurality of red light sources r for emitting red light, a plurality of green light sources g for emitting green light, and a plurality of blue light sources b for emitting blue light. Each of the light sources r, g, and b, is a light emitting diode (LED). White light is produced in accordance with a color combination of the red light from the red light sources r, the green light from the green light sources g, and the blue light from the blue light sources b.

Each of the TFTs formed at respective intersections of the data lines DL and gate lines GL inputs data on the corresponding data line DL to a corresponding liquid crystal cell, in response to a scan pulse from the gate driver GD. Each TFT includes a source electrode connected to the corresponding data line DL, a drain electrode connected to a pixel electrode of the corresponding liquid crystal cell, and a gate electrode connected to the corresponding gate line GL. The display panel 100 further includes a color filter array substrate and a TFT array substrate assembled to each other under the condition in which a liquid crystal layer is interposed between the color filter array substrate and the TFT array substrate. Color filters and common electrodes are formed on the color filter array substrate. Each of the color filters includes one of red, green, and blue color filter layers, which allow light beams of particular wavelength ranges to pass therethrough, so that the color filters can achieve color display. A black matrix is formed between the adjacent color filters of different colors.

Each liquid crystal cell includes a liquid crystal capacitor Clc for maintaining data for one frame period, and an auxiliary capacitor for stably maintaining the data for the same frame period.

The timing controller TC re-arranges digital vide data input from a digital video card for red data R, green data G, and blue data B. The data R, G, and B re-arranged by the timing controller TC are input to the data driver DD.

The timing controller TC generates a data control signal DCS and a gate control signal GCS, using a horizontal synchronizing signal Hsync, a vertical synchronizing signal Vsync, and a clock signal CLK, and supplies the generated signals DCS and GCS to the data driver DD and gate driver GD, respectively. The data control signal DCS includes a dot clock, a source shift clock, a source enable signal, a polarity inverting signal, etc. The gate control signal GCS includes a gate start pulse, a gate shift clock, a gate output enable signal, etc.

The data driver DD samples the input data in accordance with the data control signal DCS from the timing controller TC, latches the sampled data by one-line data for every horizontal time 1H, 2H, . . . , and supplies the latched data to the data lines DL. That is, the data driver DD converts the data R, G, and B received from the timing controller TC into analog pixel signals, using gamma voltages GMA1 to GMA6 received from a power generator PW, and supplies the analog pixel signals to the data lines DL.

The gate driver GD includes a shift register for sequentially generating a scan pulse in response to the gate start pulse included in the gate control signal GCS from the timing controller TC, and a level shifter for shifting the voltage of the scan pulse to a voltage level suitable for the driving of the liquid crystal cells. The gate driver GD sequentially supplies a gate-high voltage to the gate lines GL in response to the gate control signal GCS.

The power generator PW supplies a common electrode voltage Vcom to the display panel 100, and supplies the gamma voltages GMA1 to GMA6 to the data driver DD.

In accordance with the control signal CS input from the outside of the LCD device, the backlight driver 302 controls the duty rate of the first drive signal adapted to drive the red light sources r, the duty rate of the second drive signal adapted to drive the green light sources g, and the duty rate of the third drive signal adapted to drive the blue light sources b. The control signal CS includes color coordinate information and luminance information.

The control signal CS is adapted to control the colors and luminances of the light sources r, g, and b of the backlight unit 200. The control signal CS may be input by the operator or the final product user. For example, the user can generate the control signal CS by operating an input unit installed on the display device.

The color coordinate information includes information representing the color intensities of the light sources r, g, and b to be set by the user. That is, the color coordinate information represents the ratio among the red light from the red light sources r, the green light from the green light sources g, and the blue light from the blue light sources b. Generally, the luminance information of light is expressed by two-dimensional coordinates (x, y) in a CIE chromaticity diagram. FIG. 2 shows such a CIE chromaticity diagram. In FIG. 2, the left lower region represents a blue light region, the left upper region represents a green light region, and the right region represents a red light region.

As the ratio among red light, green light, and blue light is controlled, the color obtained in accordance with the mixture of the red light, green light, and blue light may be white, or may be approximate to red, green, or blue.

For example, when the color coordinate value is toward red, this means that the red component of the mixture of the red light, green light, and blue light is strengthened. In this case, accordingly, the image displayed on the display panel 100 has a red tone. On the other hand, when the color coordinate value is toward blue, this means that the blue component of the mixture of the red light, green light, and blue light is strengthened. In this case, accordingly, the image displayed on the display panel 100 has a blue tone.

The luminance information represents information of a total luminance of colors defined by color coordinates. Namely, the luminance information represents information as to the luminances of red light, green light, and blue light defined by the color coordinates. Even when red light, green light, and blue light are mixed in the same rate, the total luminance thereof may be varied in accordance with the luminance of each color. For example, light produced from a mixture of red light, green light, and blue light in a ratio of 1:3:4 and light produced from a mixture of red light, green light, and blue light in a ratio of 2:6:8 have different total luminances even though they have the same mixture ratio.

The luminance corrector 301 functions to vary luminance information included in the control signal CS. In detail, the luminance corrector 301 varies the luminance information of the control signal CS when at least one of the first to third drive signals has a duty rate of 100%.

Figure 3A:
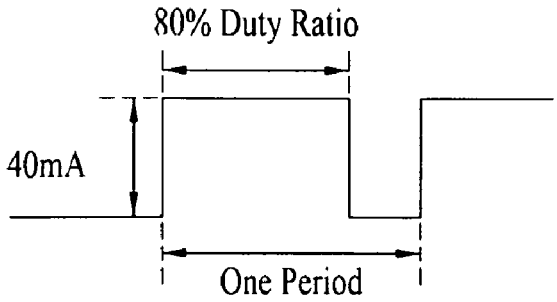
FIGS. 3A to 3C are diagrams depicting waveforms of first to third drive signals.
Figure 3B:
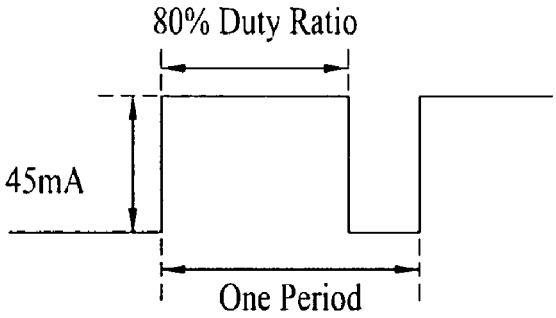
Figure 3C:
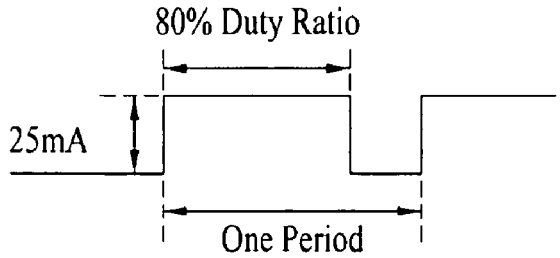
Figure 4A:
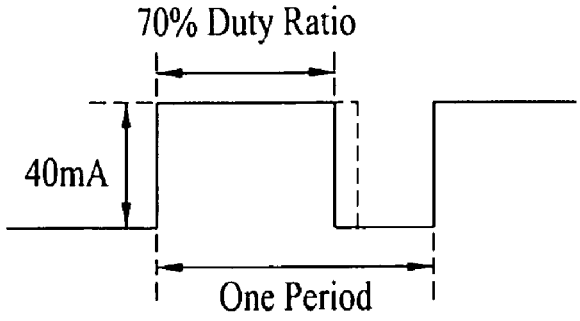
FIGS. 4A to 4C are diagrams depicting waveforms of the first to third drive signals, which have been corrected for duty rates thereof.
Figure 4B:
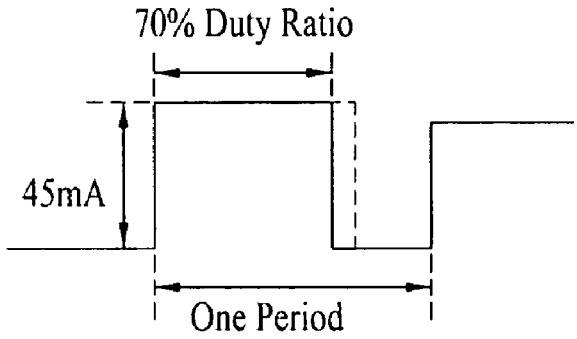
Figure 4C:
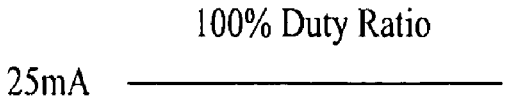

FIGS. 3A to 3C are diagrams depicting waveforms of the first to third drive signals. That is, FIG. 3A depicts the first drive signal, FIG. 3B depicts the second drive signal, and FIG. 3C depicts the third drive signal. FIGS. 4A to 4C are diagrams depicting waveforms of the first to third drive signals, which have been corrected for duty rates thereof. That is, FIG. 4A depicts the first drive signal, FIG. 4B depicts the second drive signal, and FIG. 4C depicts the third drive signal.

As shown in FIGS. 3A to 3C, the first to third drive signals initially have the same duty rate, but have different amplitudes. The duty rate represents the rate of a high-level period in one period of a pulse. Initially, all the first to third drive signals have a duty rate of about 80%. The remaining, low-level period of 20% is a margin period. When the drivability of a light source is degraded, it is possible to increase the duty rate of the corresponding drive signal, using the 20% margin period. As the duty rate increases, the luminance of the light source is increased. Meanwhile, the amplitudes of the first to third drive signals are set to be different. As a result, the amounts of current flowing through the light sources r, g, and b are different. This is because, only when the light sources r, g, and b are driven at different brightnesses, the light produced from a mixture of red light, green light, and blue light can exhibit white.

Each of the light sources r, g, and b exhibits a degradation in drivability as the drive time thereof increases. That is, although a drive signal having an initially-set duty rate is always supplied, the corresponding light source cannot provide an original luminance. In order to prevent this phenomenon, the backlight driver 302 increases the duty rates of the first to third drive signals so that the light sources can output a normal luminance. However, it is difficult to compensate for the luminance of the light sources, only through an increase in duty rate, when the luminance of the light sources decreases to about 50% of the original luminance. This is because the drive signal has a limited margin period. If any one of the three-color light sources r, g, and b cannot generate a normal luminance, even though the remaining two light sources generate the normal luminance, the luminance of the color-mixed light is degraded. Furthermore, the color of the mixed light is different from a target color.

For this reason, in accordance with the present invention, when the duty rate of any one of the first to third drive signals reaches 100%, it is determined that the light source, which receives the drive signal having the duty rate of 100%, has been degraded. In this case, the duty rates of the remaining drive signals are again set, based on the drive signal having the duty rate of 100%.

In other words, in accordance with the present invention, the drive signal having the duty rate of 100% is set as a reference signal having a fixed duty rate of 100%, and the duty rates of the remaining drive signals are again set, based on the duty rate of the reference signal. For example, it is assumed that first to third drive signals as shown in FIGS. 3A to 3C are supplied to red, green, and blue light sources r, g, and b, respectively, in order to produce white light from a mixture of red light from the red light source r, green light from the green light source g, and blue light from the blue light source b. It is also assumed that the duty rate of the first drive signal has reached 100% due to a degradation in the blue light source b, after the driving of the red, green, and blue light sources r, g, and b for a prolonged period of time, but the remaining light sources, namely, the red and green light sources r and g, still driven by their drive signals still having the initial duty rate of 80% because they are not degraded. In this case, the red and green light sources r and g emit light having an originally-targeted luminance by their drive signals having a duty rate of 80%. However, the blue light source b cannot exhibit an original luminance even though the third drive signal, which has a maximum duty rate, namely, a duty rate of 100%, is applied to the blue light source b, because the blue light source b is in a severely-degraded state. If the duty rate of the third drive signal is increased to exceed 100%, the blue light source b may emit blue light having a normal luminance. In practice, however, not only the third drive signal, but also the first and second drive signals cannot exceed 100%. To this end, in accordance with the present invention, the duty rate of the third drive signal is set to 100%, as shown in FIG. 4C, in order to enable the degraded blue light source b to emit light having a luminance as high as possible. In order to normally render the color of light produced from a mixture of the three-color light beams, the duty rate of the first drive signal for driving the red light source r and the duty rate of the second drive signal for driving the green light source g may be reduced from their original duty rates, respectively. That is, since the blue light source b emits light having a luminance lower than the normal luminance, the remaining light sources each emitting a normal luminance, namely, the red and green light sources r and g, are controlled such that the luminance of each of the red and green light sources r and g is reduced by a certain rate based on the luminance of the blue light source b, in accordance with the present invention. In this case, it is possible to maintain the three-color-mixed light at an originally-targeted color even though the luminance of the mixed light is reduced. In other words, when the original luminances of the red light and green light are reduced in accordance with the luminance ratio among the red light, green light, and blue light under the condition in which the luminance ratio among the red light, green light, and blue light is maintained in accordance with color information, the light produced from a mixture of the three-color light beams (for example, white light) can exhibit a normal color because the luminance ratio among the red light, green light, and blue light can be normally maintained even though a reduction in total luminance occurs. Of course, in this case, the luminance of the three-color-mixed light may be reduced, as described above. In user's place, however, a slight reduction in total luminance is considerably better than a distortion of image color.

For the above-described function, the luminance corrector 301 and backlight driver 302 may have the following configurations.

Figure 5:
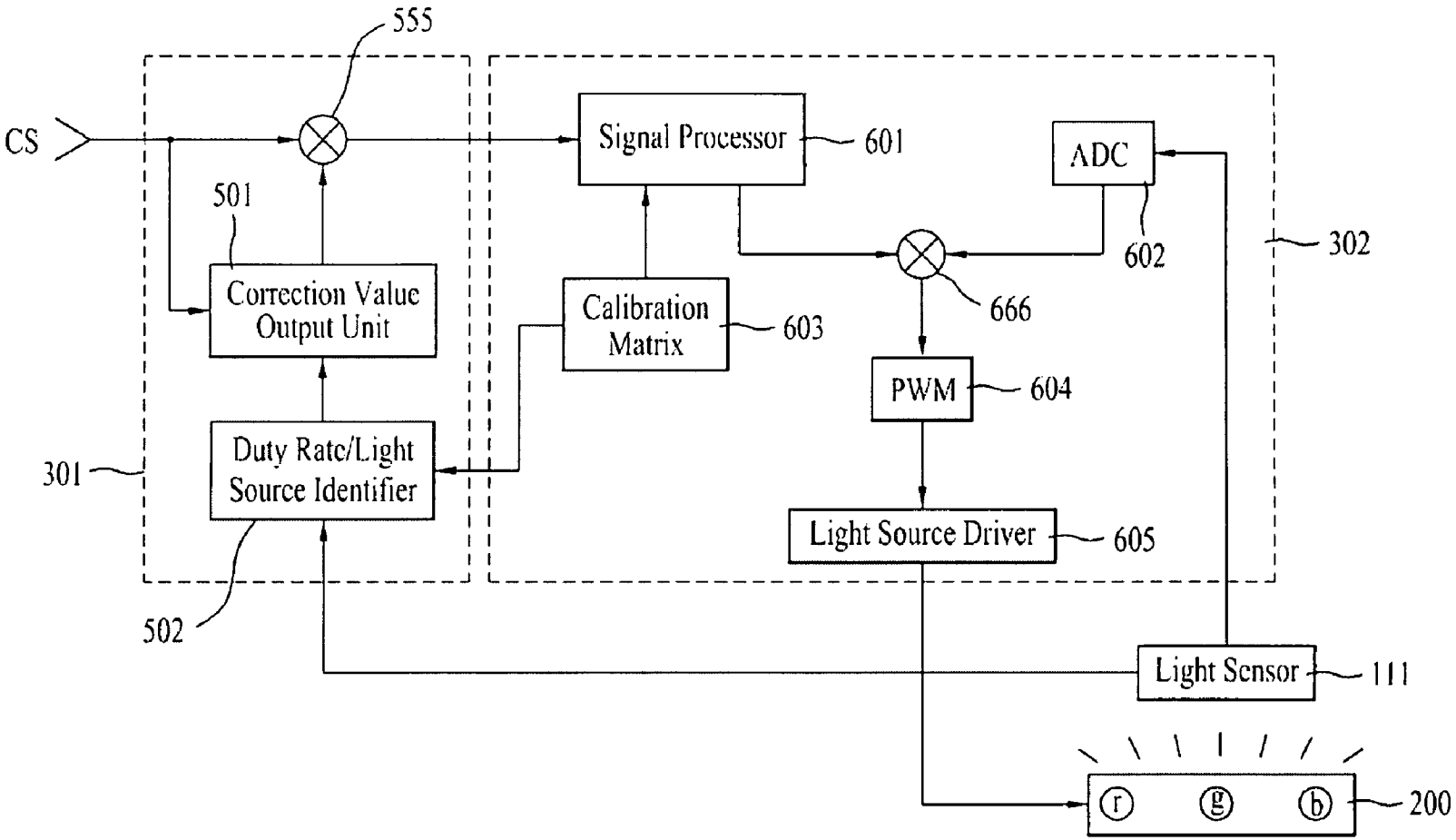
FIG. 5 is a block diagram illustrating detailed configurations of a luminance corrector and a backlight driver shown in FIG. 1.

FIG. 5 is a block diagram illustrating detailed configurations of the luminance corrector 301 and backlight driver 302 shown in FIG. 1.

As shown in FIG. 5, the luminance corrector 301 according to the present invention includes a duty rate/light source identifier 502 for receiving the first to third drive signals from the backlight driver 302 and first to third light sensing signals from the light sensor 111, thereby identifying a drive signal having a duty rate of 100% and the luminance of the light source driven by the drive signal having the duty rate of 100%. The luminance corrector 301 also includes a correction value output unit 501 for selecting a luminance correction value from among a plurality of previously-stored luminance correction values in accordance with the result of identification from the duty rate/light source identifier 502 and the control signal CS supplied from the outside, and outputting the selected luminance correction value, and a first calculator 555 for receiving the luminance correction value from the correction value output unit 501 and the control signal CS, varying the luminance information included in the control signal CS using the luminance correction value, and supplying the control signal CS including the varied luminance information to the backlight driver 302.

The duty rate/light source identifier 502 receives the first to third light sensing signals from the light sensor 111, and identifies the actual luminance of the light source driven by the drive signal having the duty rate of 100%. The first light sensing signal is a signal generated based on light emitted from the red light sources r, the second light sensing signal is a signal generated based on light emitted from the green light sources g, and the third light sensing signal is a signal generated based on light emitted from the blue light sources b.

The light sources r, g, and b are driven by the first to third drive signals generated from the backlight driver 302 in accordance with the color information and luminance information included in the control signal CS, respectively. When the color information is varied in accordance with the correction value from the correction value output unit 501, one of the light sources r, g, and b is driven by the drive signal having the duty rate of 100%. In this case, the light sensor 111 senses light emitted from the light source driven by the drive signal having the duty rate of 100%, and supplies a light source signal based on the sensed light to the duty rate/light source identifier 502. Of course, the light sensor 111 may receive all the first to third light sensing signals because all the light sources r, g, and b can be driven by the drive signal having the duty rate of 100%.

The duty rate/light source identifier 502 converts the first to third light sensing signals into corresponding digital signals, respectively, and then identifies which light source currently receives the drive signal having the duty rate of 100%. That is, the duty rate/light source identifier 502 receives the first to third drive signals from the backlight unit 302, and identifies the drive signal having the duty rate of 100% from the first to third drive signals to identify which light source is driven by the drive signal having the duty rate of 100%. Thereafter, the duty rate/light source identifier 502 selects the light sensing signal corresponding to the identified light source, and identifies the luminance (maximum luminance) of the selected light sensing signal. Thus, the duty rate/light source identifier 502 can identify the light source currently driven by the drive signal having the duty rate of 100% and the actual luminance (maximum luminance) of light emitted from the identified light source. Subsequently, the duty rate/light source identifier 502 signalizes the identified information, and supplies the resultant signal to the correction value output unit 501. Based on the information from the duty rate/light source identifier 502, the correction value output unit 501 selects a desired one of the previously-set correction values, and supplies the selected correction value to the first calculator 555.

That is, the correction value output unit 501 outputs a desired one of the correction values based on the information as to the drive signal having the duty rate of 100%, the information as to the luminance of the light source driven by the drive signal having the duty rate of 100%, and the color coordinate information included in the control signal CS.

For example, if the drive signal identified as having the duty rate of 100% is the third drive signal, so that the blue light sources b are selected, the duty rate/light source identifier 502 identifies the luminance of the blue light sources b, and supplies the resultant luminance information to the correction value output unit 501. Based on the luminance information, the correction value output unit 501 analyzes the color coordinate information to determine the ratio among colors to be currently rendered, namely, the luminance ratio among red light, green light, and blue light. Thereafter, the correction value output unit 501 calculates the luminances of red light and green light based on the actual luminance information of blue light (the actual maximum luminance obtained when the blue light sources b are driven by the third drive signal having the duty rate of 100%) supplied from the duty rate/light source identifier 502. In this case, the correction value output unit 501 calculates the luminance of red light and the luminance of blue light so that the luminance ratio among red light, green light, and blue light according to the color coordinate information can be maintained. Thereafter, the correction value output unit 501 calculates the total luminance by summing the calculated luminances of red right and green light and the luminance of blue right driven by the third drive signal, and then calculates the difference between the calculated total luminance and the luminance represented by the luminance information included in the control signal CS. This luminance difference is the luminance correction value to be supplied to the first calculator 555.

The duty rate/light source identifier 502 may directly receive the first to third light sensing signals from the light sensor 111. Alternatively, the duty rate/light source identifier 502 may receive the first to third light sensing signals from an analog-digital converter (ADC), which will be described later.

Once the light sources r, g, and b are driven in accordance with the control signal CS supplied from the outside, the luminance corrector 301 measures the luminances output from the light sources r, g, and b, and then derives a luminance correction value for varying the luminance information included in the control signal CS based on the result of the measurement.

The derived luminance correction value and the control signal CS are supplied to the first calculator 555. Based on the luminance correction value, the first calculator 55 varies the luminance information included in the control signal CS. The control signal CS output from the first calculator 555, namely, the control signal CS including the color information and the varied luminance information, is supplied to the backlight driver 302.

The backlight driver 302 includes a signal processor 601 for generating first to third modulated signals using the color information and varied luminance information included in the control signal CS from the first calculator 555, and an algorithm stored in a calibration matrix 603. The backlight driver 302 also includes an ADC 602 for converting the first to third light sensing signals from the light sensor 111 into corresponding digital signals, respectively, and a second calculator 666 for comparing the first to third modulated signals from the signal processor 601 with the first to third light sensing signals from the ADC 602, respectively, and correcting the first to third modulated signals based on the results of the comparison. The backlight driver 302 further includes a pulsewidth modulator 604 for executing a pulsewidth modulation for the corrected first to third modulated signals from the second calculator 666, and outputting the resultant signals as the first to third drive signals, and a light source driver 605 for driving the red light sources r, green light sources g, and blue light sources b based on the first to third drive signals from the pulsewidth modulator 604.

The signal processor 601 functions to modulate the control signal CS such that the image reproduced in the display device is displayed with the same color as that of an original object. That is, the signal processor 601 generates the first to third modulated signals using the color information and varied luminance information included in the control signal CS, and the algorithm stored in a calibration matrix 603. The first modulated signal is a signal associated with the luminance of the red light sources r, the second modulated signal is a signal associated with the luminance of the green light sources g, and the third modulated signal is a signal associated with the luminance of the blue light sources b. The first to third modulated signals generated as described above are supplied to the second calculator 666.

In addition to the first to third modulated signals, the second calculator 666 receives the first to third light sensing signals from the light sensor 111. Since the first to third light sensing signals from the light sensor 111 are analog signals, they are input to the second calculator 666 after being converted into digital signals by the ADC 602.

The light sensor 111 includes a red light sensor for sensing red light from the red light sources r, a green light sensor for sensing green light from the green light sources g, and a blue light sensor for sensing blue light from the blue light sources b.

The ADC 602 includes a first ADC for converting the first light sensing signal from the red light sensor into a digital signal, a second ADC for converting the second light sensing signal from the green light sensor into a digital signal, and a third ADC for converting the third light sensing signal from the blue light sensor into a digital signal.

The second calculator 666 receives the first to third modulated signals from the signal processor 601 and the first to third light sensing signals from the ADC 602, and compares the received signals with each other. That is, the second calculator 666 compares the first modulated signal with the first light sensing signal, to determine whether or not the first modulated signal actually represents the measured luminance of the red light sources r. When there is a difference between the compared signals, the second calculator 666 adds the predetermined correction value to the first modulated signal, to correct the first modulated signal. In the same manner, the second calculator 666 compares the second modulated signal with the second light sensing signal, and corrects the second modulated signal. In the same manner, the second calculator 666 also compares the third modulated signal with the third light sensing signals, and corrects the third modulated signal.

The pulsewidth modulator 604 generates the first drive signal, using the first modulated signal from the second calculator 666. Also, the pulsewidth modulator 604 generates the second drive signal, using the second modulated signal from the second calculator 666, and generates the third drive signal, using the third modulated signal from the second calculator 666. For these functions, the pulsewidth modulator 604 includes a first pulse width modulator for modulating the pulsewidth of the first modulated signal, a second pulse width modulator for modulating the pulsewidth of the second modulated signal, and a third pulse width modulator for modulating the pulsewidth of the third modulated signal.

The light source driver 605 receives the pulsewidth-modulated first to third drive signals from the pulsewidth modulator 604, and drives the light sources r, g, and b in accordance with the first to third drive signals. For these functions, the light source driver 605 includes a red light driver for driving the red light sources r, using the first drive signal, a green light driver for driving the green light sources g, using the second drive signal, and a blue light driver for driving the blue light sources b, using the third drive signal.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display device comprising:

a display panel for displaying an image;

a backlight unit comprising a plurality red light sources, a plurality of green light sources, and a plurality of blue light sources;

a backlight driver for controlling a duty rate of a first drive signal to drive the red light sources, a duty rate of a second drive signal to drive the green light sources, and a duty rate of a third drive signal to drive the blue light sources, in accordance with a control signal including color coordinate information and luminance information;

a luminance corrector for varying the luminance information of the control signal when the duty rate of one of the first to third drive signal is 100%; and a light sensor for sensing light beams from the light sources, generating light sensing signals based on the sensed light beams, and supplying the light sensing signals to the backlight driver and to the luminance corrector;

wherein, in response to the control signal including the color coordinate information and the varied luminance information, the backlight driver sets the drive signal having the duty rate of 100% as a reference signal, and maintains the duty rate of the reference signal at 100%, while again setting the duty rates of the remaining drive signals, to meet the color coordinate information of the control signal.

2. The liquid crystal display device according to claim 1, wherein, in response to the control signal including the color coordinate information and the varied luminance information, the backlight driver sets one of the drive signals having the duty rate of 100% as a reference signal, and maintains the duty rate of the reference signal at 100%, while reducing the duty rates of the remaining drive signals, to meet the color coordinate information of the control signal.

3. The liquid crystal display device according to claim 1, wherein the luminance corrector comprises:

a duty rate/light source identifier for receiving the first to third drive signals from the backlight driver and first to third light sensing signals from the light sensor, thereby identifying the drive signal having the duty rate of 100% and a luminance of the light source driven by the drive signal having the duty rate of 100%;

a correction value output unit for selecting a luminance correction value from among a plurality of previously-stored luminance correction values in accordance with the result of identification from the duty rate/light source identifier and the control signal supplied from an outside of the liquid crystal display device, and outputting the selected luminance correction value; and a first calculator for receiving the luminance correction value from the correction value output unit and the control signal from the outside of the liquid crystal display device, varying the luminance information of the control signal, using the luminance correction value, and supplying the control signal including the varied luminance information to the backlight driver.

4. The liquid crystal display device according to claim 3, wherein the backlight driver comprises:

a signal processor for generating first to third modulated signals, using the color coordinate information and the varied luminance information, which are included in the control signal from the first calculator, and an algorithm stored in a calibration matrix;

an analog-digital converter for converting the first to third light sensing signals from the light sensor into corresponding digital signals, respectively;

a second calculator for comparing the first to third modulated signals from the signal processor with the first to third light sensing signals from the analog-digital converter, respectively, and correcting the first to third modulated signals, based on the results of the comparison;

a pulsewidth modulator for executing a pulsewidth modulation for the corrected first to third modulated signals from the second calculator, and outputting the resultant signals as the first to third drive signals; and a light source driver for driving the red light sources, the green light sources, and the blue light sources, based on the first to third drive signals from the pulsewidth modulator.

5. A method for driving a liquid crystal display device including a display panel for displaying an image, a backlight unit comprising a plurality red light sources, a plurality of green light sources, and a plurality of blue light sources, a backlight driver for controlling a duty rate of a first drive signal to drive the red light sources, a duty rate of a second drive signal to drive the green light sources, and a duty rate of a third drive signal to drive the blue light sources, in accordance with a control signal including color coordinate information and luminance information, and a light sensor for sensing light beams from the light sources, generating light sensing signals based on the sensed light beams, and supplying the light sensing signals to the backlight driver and to a luminance corrector, comprising:

checking the first to third drive signals from the backlight driver, and first to third sensing signals from the light sensor, thereby identifying a drive signal having a duty rate of 100%, and a luminance of light sources driven by the drive signal having the duty rate of 100%;

selecting a luminance correction value from a plurality of previously-stored luminance correction values in accordance with the results of the identification and the control signal supplied from an outside of the liquid crystal display device, and outputting the selected luminance correction value; and varying the luminance information of the control signal, using the selected luminance correction value, and supplying the resultant control signal, which includes the varied luminance information, to the backlight driver;

wherein, in response to the control signal including the color coordinate information and the varied luminance information, the backlight driver sets the drive signal having the duty rate of 100% as a reference signal, and maintains the duty rate of the reference signal at 100%, while again setting the duty rates of the remaining drive signals, to meet the color coordinate information of the control signal.

* * * * *